US010774547B2

(12) United States Patent
Colyn et al.

(10) Patent No.: US 10,774,547 B2
(45) Date of Patent: Sep. 15, 2020

(54) INSTALLATION AIDS FOR SIDING AND ACCESSORIES AND METHODS OF USE

(71) Applicant: CertainTeed LLC, Malvern, PA (US)

(72) Inventors: Christopher Michael Colyn, Jackson, MI (US); Ashley A. Schultz, Jackson, MI (US); Robert T. Clark, Philadelphia, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/233,697

(22) Filed: Dec. 27, 2018

(65) Prior Publication Data

US 2019/0203483 A1 Jul. 4, 2019

Related U.S. Application Data

(60) Provisional application No. 62/612,137, filed on Dec. 29, 2017.

(51) Int. Cl.
*E04F 21/18* (2006.01)
*E04F 13/08* (2006.01)

(52) U.S. Cl.
CPC ..... *E04F 21/1855* (2013.01); *E04F 13/0864* (2013.01)

(58) Field of Classification Search
CPC ..... E04F 21/1855; E04F 13/0864; E04F 13/0842; E04F 19/06; E04F 19/065; E04F 19/063; E04F 19/064; E04F 13/0803; E04F 19/024; E04F 13/076; E04B 1/6801
See application file for complete search history.

(56) References Cited

U.S. PATENT DOCUMENTS 4,189,885 A * 2/1980 Fritz ..... E04F 13/0842 52/278
4,525,933 A 7/1985 Patterson
5,319,909 A 6/1994 Singleterry
5,522,149 A 6/1996 Meyer
6,260,283 B1 7/2001 Abernathy
6,684,521 B2 2/2004 Rempe
6,886,268 B1 5/2005 Morse
6,901,681 B2 6/2005 Bueno
7,543,422 B2 6/2009 Tomczak
7,762,033 B2 7/2010 Scott
(Continued)

*Primary Examiner* — Jessie T Fonseca
(74) *Attorney, Agent, or Firm* — McDonnell Boehnen Hulbert & Berghoff LLP

(57) ABSTRACT

One aspect of the disclosure is a method of installing siding to a siding accessory using an installation aid. The method includes mounting and fastening at least one siding accessory to a surface, placing a siding panel onto the surface, the siding panel having a first side, a second side, a top edge, and a bottom edge, locking the siding panel into place, placing at least one installation aid between the first side and/or the second side of the siding panel and the at least one siding accessory, the installation aid having at least one projection spaced to create a gap between the first or second side of the siding panel and the at least one siding accessory to allow for expansion and contraction of the siding panel, sliding the siding panel over to the at least one siding accessory, and fastening the siding panel to the surface. Various embodiments of installation aids are also disclosed.

20 Claims, 5 Drawing Sheets

(56) References Cited

U.S. PATENT DOCUMENTS

| | | | | |
|---|---|---|---|---|
| 8,104,234 | B1 * | 1/2012 | Sawyer | E04D 13/158 52/309.8 |
| 8,596,000 | B2 * | 12/2013 | Mitchell | E04C 2/38 52/288.1 |
| 2007/0130878 | A1 | 6/2007 | Davis | |
| 2013/0205712 | A1 | 8/2013 | Butler | |
| 2014/0311072 | A1 * | 10/2014 | Anderson | E04F 13/0864 52/309.4 |
| 2016/0060883 | A1 * | 3/2016 | Fetterman | E04F 21/1855 52/747.1 |

* cited by examiner

INSTALLATION AIDS FOR SIDING AND ACCESSORIES AND METHODS OF USE

CROSS-REFERENCE TO RELATED APPLICATIONS

This application claims the benefit of priority of U.S. Provisional Patent Application No. 62/612,137, filed Dec. 29, 2017, which is hereby incorporated herein by reference in its entirety.

BACKGROUND OF THE DISCLOSURE

1. Field of the Disclosure

The present disclosure relates generally to siding installation. The present disclosure relates more particularly to installation aids to be used when installing siding with siding accessories that ensure adequate spacing of siding to siding accessories at all temperatures.

2. Technical Background

Siding products can simulate traditional materials such as wooden clapboards, cedar shakes and the like. Traditional wood siding materials are generally installed in overlapped single tiers or courses. Each wood clapboard course typically includes a row of horizontally elongated planks (clapboards), butted end to end, with each additional course slightly overlapping the previous course. Additionally, another style of traditional wood siding would be various vertically installed claddings, i.e. board and batten, tongue and groove, chamfer board, etc. Similarly, shingle or shake siding typically includes horizontally aligned rows of single laterally-adjacent shingles or shakes. Except at the extreme top and bottom, each row is overlapped at its top or side edge by a next higher course, and in turn laps over a next lower course, to the edges of the sided area.

Siding panels typically are fastened to the building using nails or other fasteners along a nailing hem or strip provided along the top or side edge of each siding panel. The nailing strip is overlapped and concealed by the next higher course of siding.

In multiple siding styles, clearance is needed to accommodate thermal expansion and contraction. Siding materials such as vinyl and other polymers and resins often have a high coefficient of thermal expansion, and regularly cycle through a range of temperature conditions due to exterior installations and exposure to the elements. Thermal expansion is accommodated by providing clearance that permits the siding to expand at higher temperatures and to contract at lower temperatures.

Clearance is also needed so that the ends of panels that extend up to obstructions, or terminate at outside corners or the like, can be fitted under covering molding strips during installation. Siding accessories such as J-moldings, for example, are used to frame windows, doors, roof lines, etc., where the moldings form channels to receive and cover the extreme ends of the panels. The panels need clearance, along the direction of elongation of the course, so that the installer can fit each endmost panel into its course and then slide the panel endwise into the channel of the J-molding or similar trim. The channel or trim should be deep enough to cover the end of the adjacent panel when the panel and the course as a whole have retracted in cold weather. The fit of the panels, fasteners, and any joints along the course should be loose enough so the panels can slide as needed.

If the appropriate size gap in accessory channels is not present to accommodate for thermal expansion and contraction, the siding panels may warp, distort, bend, buckle, or even crack over time when exposed to extreme temperatures. Since the siding is often installed by a number of different individuals, variations may exist in the clearance or gaps left in the accessory channels during installation. Accordingly, there is a need for a siding installation aid that ensures adequate and consistent spacing between siding and siding accessories at all temperatures, and therefore eliminates the uncertainty of a quality installation.

SUMMARY OF THE DISCLOSURE

One aspect of the disclosure is a method for installing siding using an installation aid comprising:

mounting and fastening at least one siding accessory to a surface;

placing a siding panel onto the surface, the siding panel having a first side, a second side, a top edge, and a bottom edge;

locking the siding panel into place;

placing at least one installation aid between the first side and/or the second side of the siding panel and the at least one siding accessory, the installation aid having at least one projection spaced to create a gap between the first or second side of the siding panel and the at least one siding accessory to allow for expansion and contraction of the siding panel;

sliding the siding panel over to the at least one siding accessory; and fastening the siding panel to the surface.

In certain embodiments, the installation aid may create a gap of about ¼ in., and in other embodiments the installation aid may create a gap of about ⅜ in. In other embodiments, the installation aid may create a gap of about ½ in. In other embodiments, the installation aid may create a gap of about 3/16 in. (for vertical siding).

Another aspect of the disclosure is a method for installing siding to a siding accessory using an installation aid as described herein. The method includes:

mounting and fastening at least one siding accessory to a surface;

placing a siding panel onto the surface, the siding panel having a first side, a second side, a top edge, and a bottom edge;

locking the siding panel into place;

placing at least one installation aid on the nail hem of the siding panel, the at least one installation aid having a first end and a second end, the first end having at least one projection spaced to create a gap between the siding panel and the at least one siding accessory to allow for expansion and contraction of the siding panel;

sliding the siding panel over to the at least one siding accessory until the at least one siding accessory abuts the first end of the at least one installation aid;

fastening the siding panel to the surface; and removing the at least one installation aid.

Another aspect of the disclosure is an installation aid for installing siding to a siding accessory. The installation aid includes:

a body having a first end, a second end opposite the first end, a first edge, and a second edge opposite the first edge;

a first projection located at the first end extending in a first direction outwardly from the body, the first projection having a first thickness;

a second projection located at the first end extending in a second direction outwardly from the body, the second direction being opposite the first direction, and the second projection having a second thickness;

a first channel extending along the first edge; and a second channel extending along the second edge;

wherein the first thickness is different than the second thickness.

Another aspect of the disclosure is a method for installing siding to a siding accessory using an installation aid. The method includes:

mounting and fastening at least one siding accessory to a surface, the at least one siding accessory including at least one installation aid positioned thereon;

placing a siding panel onto the surface, the siding panel having a first side, a second side, a top edge, and a bottom edge;

locking the siding panel into place;

sliding the siding panel over to the at least one siding accessory until the siding panel abuts the at least one installation aid; and fastening the siding panel to the surface.

Another aspect of the disclosure is an installation aid for installing siding to a siding accessory. The installation aid includes:

a siding accessory having a channel therein; and a flexible projection extending from the channel, the flexible projection being configured to abut an edge of a siding panel during installation;

wherein the flexible projection is configured to accommodate expansion or contraction of the siding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

Figure 1A:
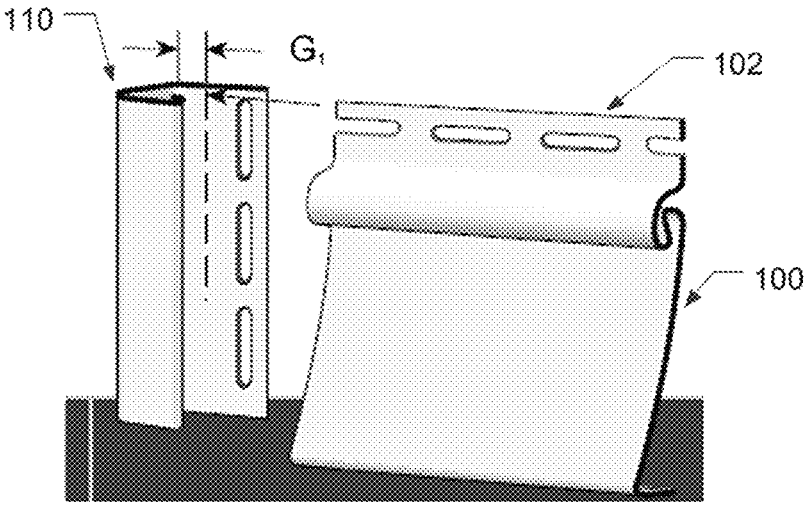
FIG. 1A PRIOR ART
FIG. 1A is a schematic front view of a horizontal siding panel and a siding accessory as known in the art.

The present inventors have noted disadvantages of conventional methods of installation of siding to siding accessories, such as trim. In one example, as shown in FIG. 1A, a horizontal siding panel 100 having nail hem 102 can be inserted into a siding accessory 110, such as a piece of trim. As noted above, when installing siding to accessories, clearance is needed to accommodate thermal expansion and contraction of the siding panels. Thus, the installer is instructed to leave a gap $G_1$ between an end of the siding panel 100 and the siding accessory 110 of anywhere in the range of about ¼ in. to about ⅜ in. Generally, if the external temperature during installation is above 40° F., the gap should be about ¼ in., and if the external temperature is below 40° F., the gap should be about ⅜ in. Other conditions may require different size gaps, such as ½ in. when using extended length siding, for example.

Figure 1B:
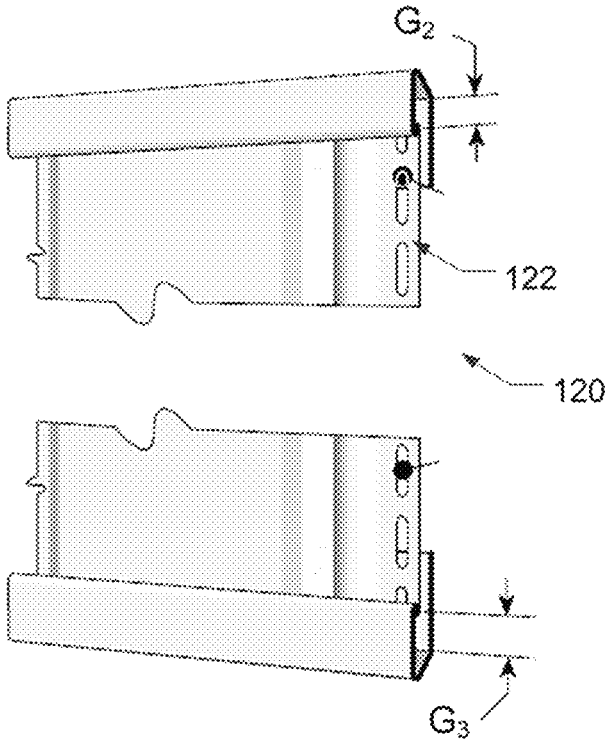
FIG. 1B PRIOR ART
FIG. 1B is a schematic front view of a vertical siding panel and siding accessories as known in the art.

FIG. 1B shows a vertical siding panel 120 having a nail hem 122. The siding panel 120 can be inserted into a top siding accessory 130 and a bottom siding accessory 140. For installation of vertical siding panels, the top gap $G_2$ should be about 3/16 in., and the bottom gap $G_3$ should be about ⅜ in. when the external temperature is greater than 40° F. When the external temperature is less than 40° F., the top gap $G_2$ should be about ¼ in. and the bottom gap $G_3$ should be about ½ in.

Since different installers may make their measurements in a slightly different manner, the gaps and spacing may not be consistent in every instance. The present inventors have noted that installation aids can facilitate installation of siding to accessories, as well as ensure consistency of spacing and therefore the overall look of the siding and accessories.

Accordingly, one aspect of the disclosure is an installation aid or tool for providing a gap between a horizontal or vertical siding panel and a siding accessory during installation of the siding. The installation aid may provide guidance to an installer during the installation of siding to siding accessories regarding the appropriate gap to leave between the edge of the siding panel and the siding accessory. In certain embodiments as otherwise disclosed herein, the installation aid may include different spacing sizes for use based on the external temperature during installation.

Figure 2:
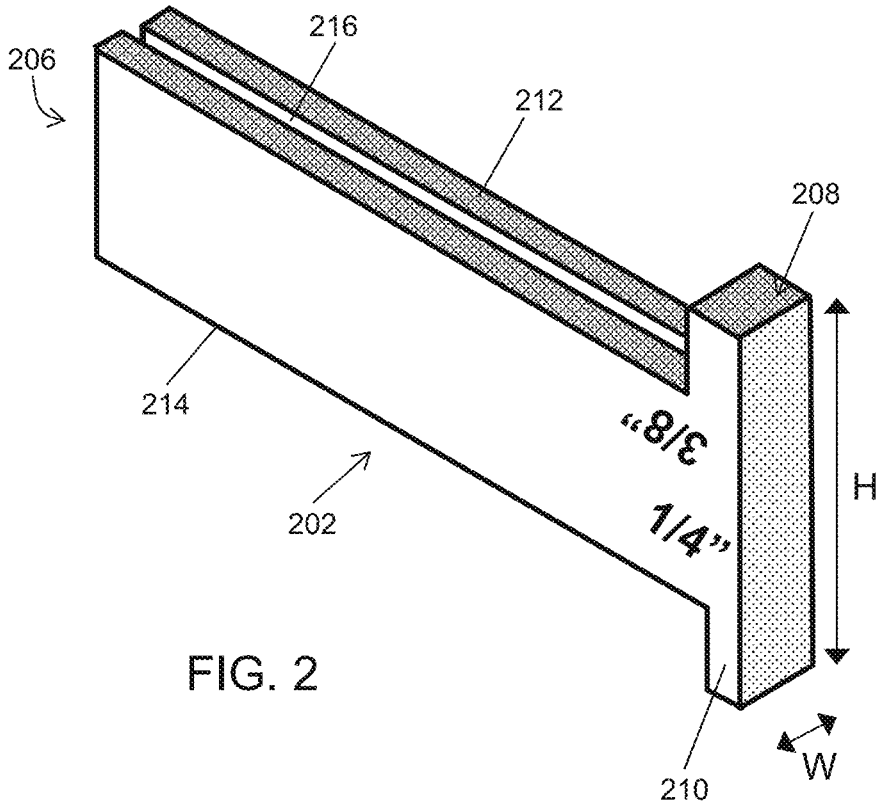
FIG. 2 is a schematic top perspective view f an example siding installation aid according to one embodiment of the disclosure.
Figure 3:
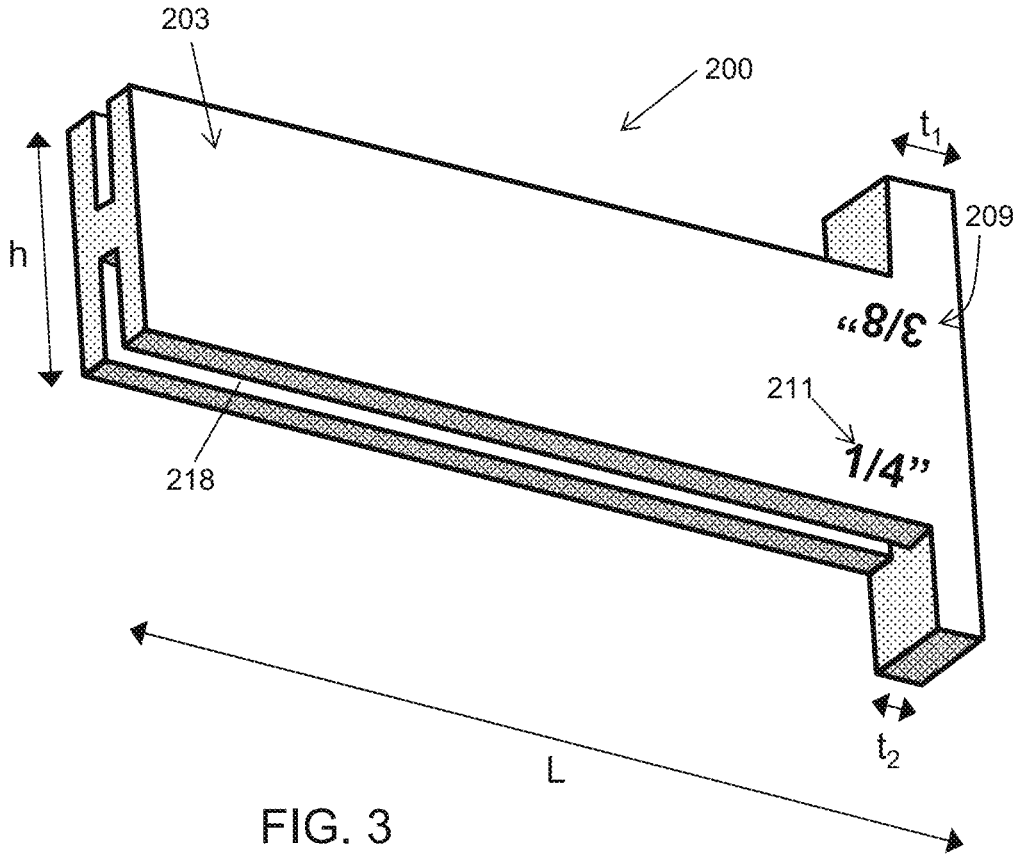
FIG. 3 is schematic bottom perspective view of a siding installation aid according to the embodiment of FIG. 2.

One embodiment of such an installation aid or tool is described with respect to FIGS. 2-5 below. FIGS. 2 and 3 each show an example installation aid 200. As shown in FIG. 2, the installation aid 200 may comprise a generally T-shaped block having a body 202, a first end 204, and a second end 206, the second end being opposite the first end.

The first end 204 includes first and second opposing projections 208, 210 which extend outwardly from the body 202. The first projection 208 may extend in a first direction outwardly from the body 202, and the second projection 210 may extend in a second direction outwardly from the body 202, the second direction being generally opposite the first direction. As shown in FIG. 3, in this embodiment, the first projection 208 has a first thickness $t_1$, which may be about ⅜ in., and the second projection 210 has a second thickness $t_2$, which may be about ¼ in. The different thicknesses $t_1$ and $t_2$ allow for the versatility of use of the installation aid 200, which will be described in more detail below. It should be understood that in certain embodiments as otherwise described herein the first and second projections 208, 210 may have the same thickness.

Referring again to FIG. 2, the body 202 further includes a first edge 212 and a second edge 214 being opposite the first edge. The first edge 212 may further include a first groove or channel 216 that extends within and along the first edge 212. Likewise, the second edge 214 may include a similar second groove or channel 218 that extends within and along the second edge 214. Although the grooves or channels 216, 218 are shown as extending the entire length of the body 202, it should be understood that in alternate embodiments the grooves or channels 216, 218 could extend only partially along the body 202. In some embodiments, the depth of the channels 216, 218 may be in the range of about ⅛ in. to about 4 in.

As best shown in FIG. 3, the first end 204 of the installation aid 200 may include indicia 209, 211 positioned on or engraved on a surface. As mentioned above, the installation aid 200 may include different spacing sizes for use based on the external temperature during installation and based on siding length or orientation/type. In one example, the first projection 208 has a first thickness $t_1$, which may be about ⅜ in., and therefore includes indicia 209 marked "⅜" thereon. The first thickness $t_1$ will create a gap of about ⅜ in. Similarly, the second projection 210 has a second thickness $t_2$, which may be about ¼ in., and therefore includes an indicia 211 marked '¼"' thereon. The second thickness $t_2$ will create a gap of about ¼ in. In certain embodiments as otherwise disclosed herein, other thicknesses may be used to create other sized gaps as may be desired in other applications, such as for longer siding, for vertical siding, or when using other materials, for example.

Although the indicia 209, 211 appears on a face 203 of the installation aid 200, it should be understood that in certain embodiments as otherwise disclosed therein the indicia 209, 211 may appear on additional and/or alternate locations of the installation aid 200, such as on first end 204, on second end 206, on an outer edge or face of projections 208, 210, on edges 212, 214, or anywhere else on the installation aid 200 where an installer could view the indicia prior to or during installation.

In certain embodiments as otherwise described herein, the installation aid 200 may take other shapes, such as, but not limited to a Y-shape, a V-shape, a triangle, a square, H-shape, or L-shape, for example. In an embodiment having an L-shape, the installation aid 200 may be configured to only create one size gap, such as 3⁄16 in, ¼ in., ⅜ in., or ½ in. only. In an embodiment having an H-shape, one side of the installation aid may be constructed like first end 204 in FIG. 2, and the other side may have a similar configuration, except may have thicknesses of ⅜ in. and ½ in., or other appropriate thicknesses, to create the appropriate gaps for extended length siding. The installation aid may be manufactured as one piece for easier production, and then can be cut by an installer at the work site for use.

The installation aid 200, in certain embodiments as otherwise described herein, may have an overall length L (e.g., from the first end 204 to the second end 206) in the range of about ½ in. to about 36 in., for example, and more particularly in the range of about 4 in. to about 8 in. Also, in certain embodiments as otherwise described herein, the installation aid 200 may have an overall height H (e.g., from the end of the first projection 208 to the end of the second projection 210) in the range of about 1⁄10 in. to about 12 in., for example, and more particularly in the range of about 2¼ in. to about 4⅛ in. In certain embodiments as otherwise described herein, the body 202 of the installation aid 200 may have a height h of about 1⁄10 in. to about 12 in., for example, and more particularly in the range of about 1 in. to about 2⅛ in. In certain embodiments as otherwise described herein, the installation aid 200 may have an overall width w of about 1⁄10 in. to about 4 in., for example, and more particularly in the range of about ⅜ in. to about ½ in.

In certain embodiments as otherwise described herein, the installation aid 200 may be comprised of any suitable material, including, but not limited to, plastic, metal, wood, ceramic, rubber, foam, or combinations thereof. In some embodiments, the installation aid may be made of any solid material that is not highly influenced by temperature changes, since the device is used for providing proper dimensional placement.

In some embodiments, the installation aid 200 may be manufactured by an injection molding process. However, it should be understood that any suitable method of manufacture may be used.

Figure 4:
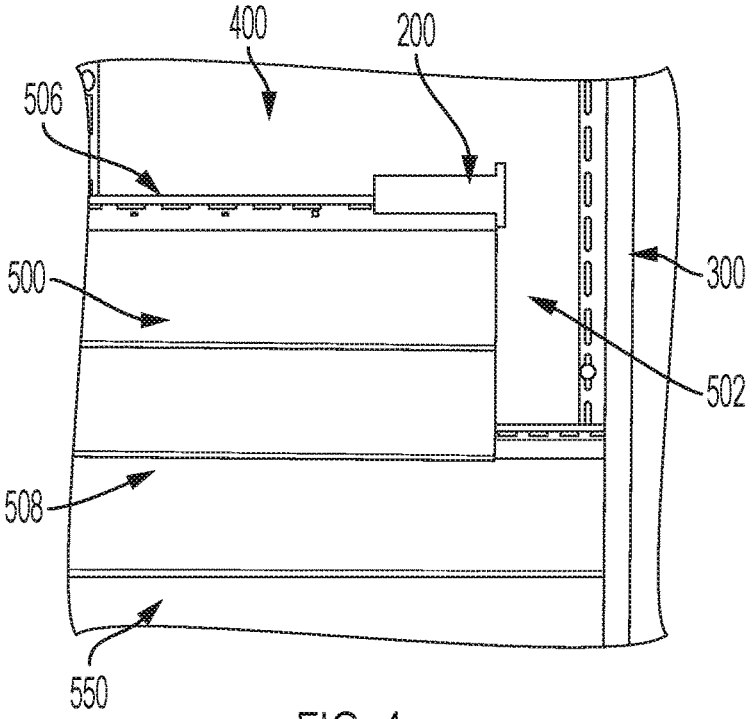
FIG. 4 is a schematic front view of the siding installation aid in use according to the embodiment of FIG. 2.
Figure 5:
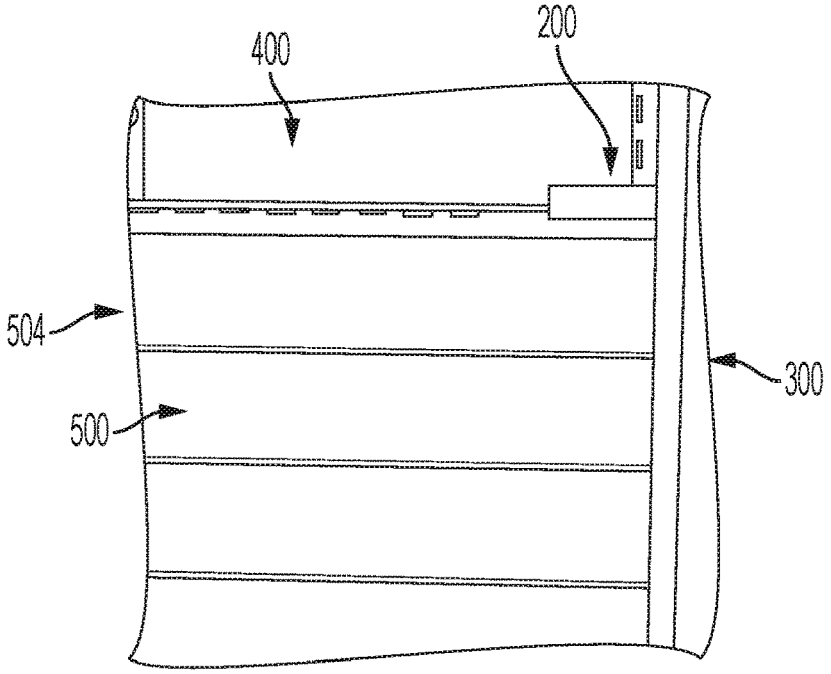
FIG. 5 is another schematic front view of the siding installation aid in use according to the embodiment of FIG. 2.

FIGS. 4 and 5 are schematic front views of the installation aid 200 in use with horizontal siding according to one embodiment. As shown in FIG. 4, a siding accessory 300, which may be a piece of trim such as a J-channel or a corner post, is mounted and fastened onto a surface 400. In most instances, the surface 400 is a vertical surface such as a wall of a building. A horizontal siding panel 500 is then placed onto the surface 400. The horizontal siding panel 500 has a first side 502, a second side 504 opposite the first side, a top edge 506, and a bottom edge 508. The top edge 506 includes a nail hem for receiving one or more fasteners to fasten the siding panel to the surface.

The horizontal siding panel 500 is then installed by conventional methods, i.e., locked into place along the bottom edge 508 to either a starter strip (not shown, for the first siding panel) or to another siding panel 550 below which has already been fastened to the surface 400. It should be understood that the locking mechanism may be any suitable siding locking mechanism known in the art. The installation aid 200 is then placed on the top edge 506 (nail hem) of the siding panel 500, between the first side 502 of the siding panel 500 and the siding accessory 300, so that one of the outwardly extending projections 208, 210 abuts the first side 502 of the siding panel. The nail hem 506 engages the first or second channel 216, 218 of the installation aid 200, depending upon in which position the installation aid 200 is placed. In certain embodiments as otherwise described herein, the nail hem 506 and channel 216, 218 engage each other via friction fit. However, it should be understood that the nail hem 506 and channel 216, 218 may fit or lock together by any known suitable connection or fastening means.

As noted above, when the external temperature during installation is below 40° F., the gap should be about ⅜ in, and therefore the installation aid 200 is placed in a first position with the first outwardly extending projection 208 extending downwardly so as to abut the first side 502 of the siding panel 500. On the other hand, and as shown in FIGS. 4-5, when the external temperature during installation is above 40° F., the gap should be about ¼ in., and therefore the installation aid 200 is placed in a second position with the second outwardly extending projection 210 extending downwardly so as to abut the first side 502 of the siding panel 500.

Next, the siding panel 500 is slid along the bottom edge 508 (along the starter strip or the hanger of the siding panel below 550) over to (in the direction of) the siding accessory 300, as shown in FIG. 5. The siding panel 500 can then be fastened to the surface 400 using any suitable fastener, such as, for example, a nail. The installation aid 200 is then removed from the siding panel, leaving the necessary gap between the first edge 502 of the siding panel 500 and the siding accessory 300.

The above method can then be repeated for the next piece of horizontal siding panel, which is placed above or adjacent to the siding panel 500, and so forth until the entire surface 400 is covered.

The installation aid 200 may also be used with vertical siding panels. Vertical siding panels are often installed with siding accessories placed above and below the siding panels, rather than on either side. In this instance, the installation aid 200 is used in a similar manner, but instead of being placed on the top edge of the siding panel, it would be placed on a side edge of the siding panel, and can be used during installation similarly to the method described above with respect to the horizontal siding. Additionally, the installation aid may be used as a means to measure and cut the appropriate length of the vertical siding panel prior to installation. As mentioned above, when the external temperature is 40° F. or above, the gap between the siding panel and the top siding accessory should be about 3/16 in., and the gap between the siding panel and the bottom siding accessory should be about ⅜ in. When the external temperature is less than 40° F., the gap between the siding panel and the top siding accessory should be about ¼ in., and the gap between the siding panel and the bottom siding accessory should be about ½ in.

Notably, the installation aid 200 can be used in a variety of ways, including by being rotated both horizontally and vertically. For example, as mentioned above, the installation aid 200 may be used to create different sized gaps between the siding panel 500 and the siding accessory 300. Thus, the installation aid 200 can be rotated 180° around a horizontal or vertical axis in order to change between different gap sizes, such as ⅜ in. and ¼ in., for example.

Furthermore, although the installation aid 200 is shown as being used on the first side 502 of the siding panel 500, it should be understood that in certain embodiments as otherwise disclosed herein the installation aid 200 may be rotated 180° around a vertical axis and used to install the siding panel 500 into a siding accessory that may be located near the second side 504 of the siding panel 500. In some embodiments, more than one installation aid 200 may be used at once, such as one installation aid on a first side of the panel and a second installation aid on a second side of the panel.

In some embodiments, the body 202 of installation aid 200 may be solid with no grooves or channels 216, 218. Thus, the installation aid 200 may rest on top of the nail hem 506 rather than engaged therewith. In this embodiment, the width of the tool could be made to fill the accessory channel.

It should be understood that in certain embodiments as otherwise disclosed herein, the installation aid 200 may be clamped or hooked onto any portion of the edge of the siding panel 500, and can be designed for alternate gap thicknesses and for easy removal after siding placement and installation.

Figure 6:
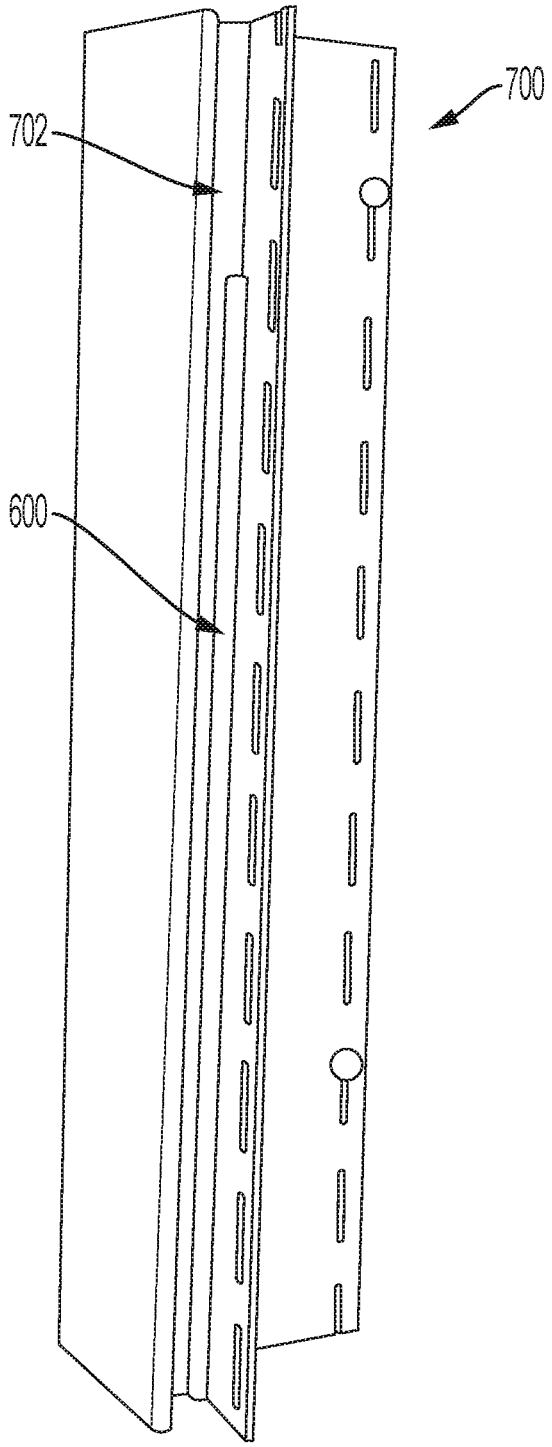
FIG. 6 is a schematic frontview of a siding installation aid according to another embodiment of the disclosure.

Another embodiment of an installation aid or tool is described with respect to FIG. 6. As shown in FIG. 6, installation aid 600 is positioned on siding accessory 700. In this embodiment, the installation aid 600 is configured as a projection, such as a flexible member or material, which is secured to or positioned on the siding accessory 700. In one embodiment, installation aid 600 is positioned on and extends from a channel 702 of the siding accessory 700. The flexible installation aid 600 may be capable of being deformed to accommodate expansion and/or contraction of the siding panel over time.

In some embodiments, the installation aid 600 may be constructed of a removable or dissolvable material, such as a flexible strip or dissolvable foam, which can be removed or will dissolve after installation of the siding panel, and will therefore create the required gap between the siding panel and the siding accessory. In some embodiments, the installation aid 600 may be constructed of a compressible material, such as foam or rubber, a deformable plastic, or a resilient (or spring back) metal. In certain embodiments as otherwise disclosed herein, the installation aid 600 may be constructed of any material that has compression properties that allow for expansion and contraction of the siding with which the particular aid is being installed.

In certain embodiments as otherwise disclosed herein, the installation aid 600 may be made integral with the siding accessory 700. For example, in one embodiment, the installation aid 600 may be configured as an integral projection protruding from the siding accessory 700. The installation aid 600 may protrude outwardly from the siding accessory anywhere from about ¼ in. to about ⅜ in. in order to create the desired gap. It should be understood that other sized gaps may be possible as well.

The installation aid 600 is used in a method similar to that described above with respect to installation aid 200. First, the siding accessory 700, which may be a piece of trim such as a J-channel or a corner post, is mounted and fastened onto a surface. In most instances, the surface 400 is a vertical surface such as a wall of a building. A horizontal siding panel is then placed onto the surface. The horizontal siding panel is similar to the horizontal siding panel 500 described above, and has a first side, a second side opposite the first side, a top edge including a nail hem, and a bottom edge.

The siding panel is then locked into place along the bottom edge to either a starter strip or to another siding panel below which has already been fastened to the surface. Next, the siding panel is slid along the bottom edge (along the starter strip or hanger of the siding panel below or adjacent) over to (in the direction of) the siding accessory until the siding panel abuts the installation aid 600 which is extending from the siding accessory 700. The siding panel can then be fastened to the surface using any suitable fastener, such as, for example, a nail. In some embodiments, as mentioned above, the installation aid 600 will deform to allow expansion and/or contraction of the siding panel over time. In other embodiments, as mentioned above, the installation aid 600 can be removed or will dissolve over time, leaving the appropriate gap between the edge of the siding panel and siding accessory.

As noted above, when the external temperature during installation is below 40° F., the gap should be about ⅜ in., and therefore the installation aid 600 is configured to project from the siding accessory 700 by about ⅜ in. On the other hand, when the external temperature during installation is above 40° F., the gap should be about ¼ in., and therefore the installation aid 600 is configured to project from the siding accessory 700 by about ¼ in.

The above method can then be repeated for the next piece of horizontal siding panel, which is placed above or adjacent to the installed siding panel, and so forth until the entire surface is covered.

Additionally, the installation aid 600 may also be used with vertical siding panels. In this instance, the method of installation would be similar, except the vertical panel would be slid along the surface either upwardly toward the top accessory or downwardly toward the bottom accessory. As mentioned above, when the external temperature is 40° F. or above, the gap between the siding panel and the top siding accessory should be about 3/16 in., and the gap between the siding panel and the bottom siding accessory should be about ⅜ in. When the external temperature is less than 40° F., the gap between the siding panel and the top siding accessory should be about ¼ in., and the gap between the siding panel and the bottom siding accessory should be about ½ in.

In various embodiments as otherwise described herein, additional embodiments of installation aids may include additional mechanical features to ensure the proper gap between the end of a siding panel and a siding accessory. For instance, in certain embodiments as otherwise disclosed herein, the installation aid 200 may further include a locking feature to lock the body 202 onto the nail hem 506 during installation, such as a thumb screw, locking cam, or wedge, for example. The locking feature may then be removed after installation.

In another example embodiment, the installation aid 200 may be rotatable or one or more of the projections may be rotatable. For instance, two sides of a rotatable projection may be of one thickness (such as 3/16 in, 1/4 in., 3/8 in., or 1/4 in.) and the other two sides of the rotatable projection may be of another thickness (such as 3/16 in., 1/4 in., 3/8 in., or 1/2 in. Thus, an installer could create different sized gaps by rotating the protrusion to the desired size.

In yet another example, instead of the outwardly extending projection(s) 208, 210 having a constant thickness ($t_1$, $t_2$), the projections may take the form of a spring, such as a leaf spring, enabling the projection to be adjustable to different thicknesses and/or widths depending upon the external temperature or the type of product being installed. The leaf spring may hook under a hanger hoop of the siding panel, and connect to a handle of the installation aid by another similar spring.

As the person of ordinary skill in the art will appreciate, the installation aids disclosed herein may be used with any known conventional siding and siding accessories, made of conventional materials. For example, the installation aids disclosed herein can be used with vinyl siding, PVC siding, polymer siding, polypropylene siding, acrylic siding, Acrylonitrile Styrene Acrylate (ASA) siding, fiberglass siding, aluminum siding, steel siding, any other plastic or metal or composite siding, or combinations thereof. Conventional methodologies for siding construction can be used in the siding panels as described herein.

Additionally, in certain embodiments as otherwise described herein, the installation aids may be used with extended length siding, e.g., siding of unconventional sizing. As mentioned above, for extended length siding, if the external temperature during installation is above 40° F., the gap should be about 3/8 in., and if the external temperature is below 40° F., the gap should be about 1/2 in.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A method for installing siding to a siding, the method comprising:

providing a first siding accessory mounted and fastened to a surface, the first siding accessory having a lateral surface; then placing a first siding panel onto the surface, the first siding panel having a first side facing the lateral surface of the first siding accessory, a second side, a top edge, and a bottom edge; locking the first siding panel into place; and placing an installation aid against the first siding panel, the installation aid having at least one projection spaced to create a gap between the first side of the siding panel and the first siding accessory to allow for expansion and contraction of the first siding panel, the first side of the first siding panel being disposed separated from the first siding accessory, the installation aid being placed such that a projection of the at least one projection is between the first side of the first siding panel and the first siding accessory; then sliding the first siding panel laterally over to the first siding accessory such that the projection of the installation aid abuts the lateral surface of the first siding accessory and the first side of the first siding panel abuts the projection of the installation aid; and then fastening the first siding panel to the surface, and removing the installation aid from between the first siding and the first siding accessory without substantially moving the first siding panel to provide the gap between the first side of the first siding panel and the first siding accessory.

2. The method of claim 1, wherein the gap provided between the first side of the first siding panel and the first siding accessory is about 1/4 in, about 3/8 in, about 1/2 in or about 3/16 in.

3. The method of claim 1 wherein the method further comprises placing the installation aid on a nail hem of the siding panel.

4. The method of claim 3 wherein the installation aid has a T-shape and comprises a body having a first end, a second end opposite the first end, a first edge, and a second edge opposite the first edge;

the first projection located at the first end of the body and extending in a first direction outwardly from the body, the first projection having a first thickness that is spaced to create the gap; and a second projection located at the first end of the body and extending in a second direction outwardly from the body, the second direction being opposite the first direction, the second projection having a second thickness.

5. The method of claim 1, wherein the first siding accessory is trim.

6. The method of claim 1 further comprising, after removing the installation aid from between the first siding panel and the first siding accessory:

placing a second siding panel onto the surface, the second siding panel having a first side, a second side, a top edge, and a bottom edge; locking the second siding panel into place with respect to the first siding panel; and placing the installation aid against the second siding panel, the installation aid being placed such that a projection of the at least one projection(s) is between the first side of the first siding panel and the first siding accessory; then sliding the second siding panel over laterally to the first siding accessory such that the projection of the installation aid abuts the lateral surface of the first siding accessory and the first side of the second siding panel abuts the projection of the installation aid; and then fastening the second siding panel to the surface and removing the installation aid from between the second siding and the first siding accessory to provide the gap between the first side of the second siding panel and the first siding accessory.

7. The method of claim 6, wherein the gap provided between the first side of the second siding panel and the first siding accessory is about 1/4 inch, about 3/8 inch, about 1/2 inch or about 3/16 inch.

8. The method of claim 1, wherein the installation aid comprises a channel, and wherein placing the installation aid comprises disposing the top edge of the first siding panel within the channel of the installation aid.

9. The method of claim 8, wherein the top edge of the first siding panel is engaged with the channel of the installation aid via friction fit.

10. The method of claim 8, wherein the installation aid is locked to the first siding panel.

11. The method of claim 8, wherein the top edge of the first siding panel is a nail hem.

12. The method of claim 1, wherein the first siding panel is locked into place with respect to a siding starter strip or a lower siding panel.

13. The method of claim 1, wherein the gap provided between the first side of the first siding panel and the first siding accessory is in the range of ¼ inch to %2 inch or about 3⁄16 inch.

14. The method of claim 1, wherein the first siding accessory includes a channel, and wherein the sliding of the first siding panel comprises moving the first end of the first siding panel from a location outside the channel of the first siding accessory to a location within the channel of the first siding accessory.

15. An installation aid for installing siding to a siding accessory, the installation aid comprising:

a body having a first end, a second end opposite the first end, a first edge, and a second edge opposite the first edge;

a first projection located at the first end extending in a first direction outwardly from the body, the first projection having a first thickness;

a second projection located at the first end extending in a second direction outwardly from the body, the second direction being opposite the first direction, and the second projection having a second thickness;

a first channel extending along the first edge; and a second channel extending along the second edge;

wherein the first thickness is different than the second thickness, and wherein a first indicia is disposed on a surface of the installation aid associated with the first projection, and a second indicia is disposed on a surface of the installation aid associated with the second projection.

16. The installation aid of claim 15 wherein the first indicia comprises ⅜" and the second indicia comprises ¼".

17. The installation aid of claim 15 wherein the first indicia comprises ½" and the second indicia comprises ⅜".

18. The installation aid of claim 15 wherein the first indicia comprises ⅜" and the second indicia comprises 3⁄16".

19. The installation aid of claim 15 wherein the first and second channels of the installation aid are each configured to engage with a nail hem of a siding panel.

20. The installation aid of claim 15 wherein the installation aid is constructed of plastic, metal, rubber, wood, ceramic or any combination or composite thereof.

* * * * *